US006247453B1

(12) United States Patent
Potschin et al.

(10) Patent No.: US 6,247,453 B1
(45) Date of Patent: Jun. 19, 2001

(54) FUEL INJECTION VALVE FOR INTERNAL COMBUSTION ENGINES

(75) Inventors: Roger Potschin, Brackenheim; Friedrich Boecking, Stuttgart, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/529,324

(22) PCT Filed: Jun. 8, 1999

(86) PCT No.: PCT/DE99/01660

§ 371 Date: Apr. 12, 2000

§ 102(e) Date: Apr. 12, 2000

(87) PCT Pub. No.: WO00/11341

PCT Pub. Date: Mar. 2, 2000

(30) Foreign Application Priority Data

Aug. 20, 1998 (DE) ..... 198 37 813

(51) Int. Cl.[7] ..... F02M 37/04

(52) U.S. Cl. ..... 123/472; 239/453

(58) Field of Search ..... 123/472; 239/533.1, 239/533.2, 585.1, 585.2, 585.4, 585.5, 453

(56) References Cited

U.S. PATENT DOCUMENTS 4,825,828 * 5/1989 Schlunke et al. ..... 239/453
5,024,385 * 6/1991 Olson ..... 239/453
5,090,625 * 2/1992 Davis ..... 239/453

FOREIGN PATENT DOCUMENTS 43 25 904 * 2/1995 (DE) .
96/25596 * 2/1995 (WO) .

* cited by examiner

*Primary Examiner*—Thomas N. Moulis
(74) *Attorney, Agent, or Firm*—Ronald E. Greigg; Edwin E. Greigg

(57) ABSTRACT

A fuel injection valve for internal combustion engines, having a valve member which is axially displaceable in a bore of a valve body and which on an end toward the combustion chamber has a valve member head. The head forms a valve closing member, which on one side toward the valve body has a sealing face, with which the sealing face cooperates with a valve seat face provided on the face end of the valve body toward the combustion chamber. An injection opening in the valve member head, which emerges from a pressure chamber, formed between the valve member and the wall of the bore, and leads away along the circumferential wall of the valve member head. The injection opening is closed by the wall of the bore when the valve member is resting on the valve seat and is opened by an outward-oriented opening stroke motion of the valve member. The valve member is actuatable by an externally controllable actuator independently of the high fuel pressure in the pressure chamber, and two pressure shoulders, facing one another and axially defining the pressure chamber, are provided on the needle-like valve member and each have substantially equal pressure engagement surface area. The pressure chamber is characterized in that one of the pressure shoulders is disposed on an end remote from the combustion chamber of the valve body, in a compensation chamber which communicates fluidically with the pressure chamber and is closed off on a face end by an axially displaceably guided pressure sleeve.

19 Claims, 1 Drawing Sheet

FUEL INJECTION VALVE FOR INTERNAL COMBUSTION ENGINES

DESCRIPTION AND PRIOR ART

The invention relates to a fuel injection valve for internal combustion engines.

Such an injection valve is disclosed for instance in German Patent DE 43 25 904 C2, as well as German Patent Application DE 197 16 226.6-13, which had not been published by the priority date of the present application.

One problem in such fuel injection valves is guiding and sealing the valve member in the valve body 1. Thus particularly if the bores are not oriented exactly, or if the valve member has slight kinks, guidance and sealing problems occur.

ADVANTAGES OF THE INVENTION

The fuel injection valve according to the invention has the advantage over the prior art that the guidance and sealing is improved over the fuel injection valves for internal combustion engines known from the prior art. Disposing one pressure shoulder on the end remote from the combustion chamber of the valve body in a compensation chamber communicating fluidically with the pressure chamber and closed off on its face end by an axially displaceably guided pressure sleeve has the particularly great advantage that the compensation chamber always communicates with the pressure chamber. This assures that the pressure shoulder will always be acted upon by a pressure; it is assured that pressure differences, for instance when the fuel injection valve opens, between the pressure chamber and the compensation chamber are compensated for directly. In this way, a restoration to the closing position of the fuel injection valve is always provided—even if a force acting in the opening direction is exerted on the valve member, for instance because of a leak toward the combustion chamber, caused by a resultant pressure difference between the pressure shoulders. The valve member is advantageously formed in needle-like fashion between the two pressure shoulders and has a constant diameter. Because the valve member is embodied as a thin needle of constant diameter between the two pressure shoulders, a slight offset between the guides, formed hand by the valve member head other by the pressure sleeve, can be compensated for in a simple and advantageous way.

To avoid leaks, the pressure sleeve is preferably press-fitted onto the valve member. Purely in principle, the compensation chamber can be embodied in an arbitrary way. One embodiment that is advantageous in particular with respect to ease of manufacture provides that the compensation chamber annularly surrounds the pressure shoulder remote from the combustion chamber.

The high-pressure delivery of fuel to the fuel injection valve is preferably done from a high-pressure reservoir common to all the fuel injection valves, and the high-pressure reservoir can in turn be filled via a high-pressure fuel pump.

The actuator for actuating the valve member is advantageously an electromechanical actuator. In particular, it is embodied as a piezoelectric actuator or electromagnet.

Further advantages and advantageous features of the subject of the invention can be learned from the description, drawing and claims.

DESCRIPTION OF THE EXEMPLARY EMBODIMENTS

Figure 1:
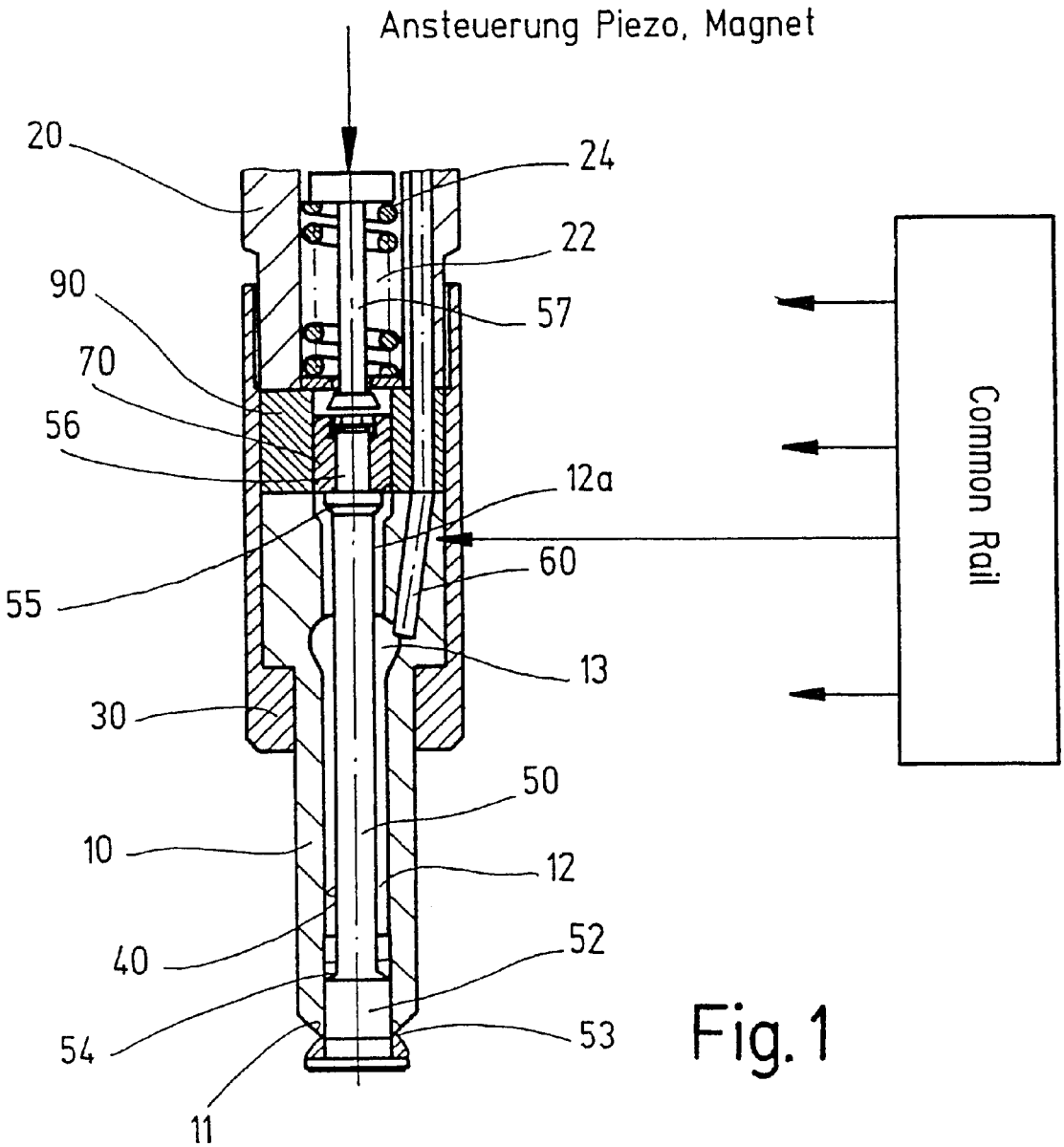
FIG. 1, schematically in section, the lower region of a fuel injection valve for internal combustion engines that makes use of the invention.

One exemplary embodiment of a fuel injection valve for internal combustion engines, whose lower portion toward the combustion chamber is schematically shown in section in FIG. 1, has a valve body 10, which is axially fastened firmly to a valve holder body 20 by means of a union nut 30.

The valve body 10 has an axial guide bore 40, in which a needle-like valve member 50 is guided axially displaceably; on its lower end, protruding into a combustion chamber (not shown) of the engine to be supplied with fuel, this valve member has a valve head 52 acting as a valve closing member. This valve head 52 protrudes out of the bore and has a conical sealing face 53 oriented toward the valve body 10; in the exemplary embodiment shown, the sealing face is formed by a seat ring mounted on the valve head 52, and the seat ring cooperates with a corresponding valve seat face 11 on the face end toward the combustion chamber of the valve body 10.

Between the wall of the bore 40 and a part of the shaft of the valve member 50, a pressure chamber 12 is formed in the valve body; the pressure chamber is defined axially by pressure shoulders 54 and 55 each embodied on the valve member 50.

An inflow bore 60 discharges into this pressure chamber 12, in a volume of the pressure chamber 12 that is enlarged in the form of a pressure chamber 13, in a manner known per se.

The pressure shoulder 55 disposed on the end of the pressure chamber 12 remote from the combustion chamber has the same pressure engagement area as the pressure shoulder 54 embodied near the combustion chamber on the valve member head 52, so that the valve member 50 is in pressure equilibrium. In this way, the fuel injection valve is prevented from opening by itself because of the common rail pressure applied.

Figure 2:
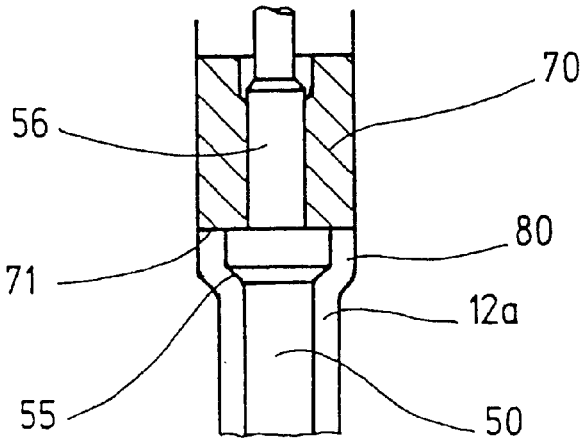
FIG. 2, schematically in section and enlarged, the end remote from the combustion chamber of the valve body of the fuel injection valve for internal combustion engines that is shown in FIG. 1.

As seen from FIG. 1 and in particular FIG. 2, the fuel injection valve has a further engagement face, additionally acted upon by high fuel pressure, by way of which the high fuel pressure applied to the injection valve acts in the closing direction on the valve member 50. This additional pressure engagement area is formed by a lower end face 71, toward the combustion chamber, of a pressure sleeve 70, which closes a compensation chamber 80 on a side remote from the combustion chamber; this compensation chamber 80 annularly surrounds the pressure shoulder 55 remote from the combustion chamber and communicates fluidically with the pressure chamber 12. In this way, the compensation chamber 80 forms the closure, remote from the combustion chamber, of the pressure chamber 12. The sleeve 70 is guided axially displaceably in an annular body 90. To prevent leaks, the sleeve 70 is press-fitted onto the upper portion 56 of the shaft of the valve member 50. Since the pressure engagement face formed by the end face 71 is slightly larger than the pressure engagement face of the shoulders 54 and 55, a restoration of the fuel injection valve in the closing direction is assured even if a slight leak that leads to an undesired opening of the fuel injection valve has occurred, for instance because of the high stress on the fuel injection valve in the region of the valve member head 52.

As also seen from FIG. 1, the valve member shaft 56 is adjoined by a further shaft portion 57, which protrudes into a spring chamber 22 provided in the valve holder body 20. For opening the fuel injection valve, an axial displacement of the valve member 50 and thus an opening of the injection opening (not shown) provided in the valve member head 52 are brought about counter to the restoring force of a valve spring 24, by triggering of an electromechanical actuator, such as a piezoelectric actuator or an electromagnet.

The region between the two pressure shoulders 54 and 55 of the valve member 50 is embodied in needle-like fashion with a constant diameter. The elasticity of the valve member 50 that is thus made possible, in particular perpendicular to the axis of the valve member, advantageously makes it possible to compensate for any offset between the guides of the valve member 50, which are formed by the pressure sleeve 70 and the valve member head 52, in the middle region of the needle-like region.

As a result of the direct communication of the compensation chamber with the pressure chamber 12 via the inlet 12*a*, pressure differences, for instance upon opening of the fuel injection valve, between the pressure chamber 12 and compensation chamber 80 are compensated for directly.

The foregoing relates to a preferred exemplary embodiments of the invention, it being understood that other variants and embodiments thereof are possible within the spirit and scope of the invention, the latter being defined by the appended claims.

What is claimed is:

1. A fuel injection valve for internal combustion engines, comprising a valve member (50) which is axially displaceable in a bore (40) of a valve body (10) and which on an end toward the combustion chamber said valve body has a valve member head (52), said head forming a valve closing member, which on a side toward the valve body (10) has a sealing face (53), with which the head cooperates with a valve seat face (11) provided on the face end of the valve body (10) toward the combustion chamber, injection openings in the valve member head (52), which emerge from a pressure chamber (12), formed between the valve member (50) and a wall of the bore (40), the injection opening lead away along the circumferential wall of the valve member head (52), the injection openings being closed by the wall of the bore (40) when the valve member (50) is resting on the valve seat (11) and the injection opening are opened by an outward-oriented opening stroke motion of the valve member (50), the valve member is actuatable by an externally controllable actuator independently of a high fuel pressure in the pressure chamber (12), and two pressure shoulders (54, 55), facing one another and axially defining the pressure chamber, are provided on the needle-like valve member (50) and each shoulder has a substantially equal pressure engagement surface area, one of the pressure shoulders (55) is disposed on an end of the valve body (10) remote from the combustion chamber, in a compensation chamber (80) which communicates fluidically with the pressure chamber (12) and is closed off on a face end by an axially displaceably guided pressure sleeve (70).

2. The fuel injection valve according to claim 1, in which the valve member (50) is formed in needle-like fashion between the two pressure shoulders (54, 55) and has a constant diameter.

3. The fuel injection valve according to claim 1, in which the pressure sleeve (70) is press-fitted onto the valve member (50).

4. The fuel injection valve according to claim 2, in which the pressure sleeve (70) is press-fitted onto the valve member (50).

5. The fuel injection valve according to claim 3, in which the compensation chamber (80) annularly surrounds the pressure shoulder (55) remote from the combustion chamber.

6. The fuel injection valve according to claim 4, in which the compensation chamber (80) annularly surrounds the pressure shoulder (55) remote from the combustion chamber.

7. The fuel injection valve according to claim 1, in which the high-pressure fuel delivery is effected from a high-pressure reservoir that is common to all the fuel valves, and the high-pressure reservoir in turn can be filled via a high-pressure fuel pump.

8. The fuel injection valve according to claim 2, in which the high-pressure fuel delivery is effected from a high-pressure reservoir that is common to all the fuel valves, and the high-pressure reservoir in turn can be filled via a high-pressure fuel pump.

9. The fuel injection valve according to claim 3, in which the high-pressure fuel delivery is effected from a high-pressure reservoir that is common to all the fuel valves, and the high-pressure reservoir in turn can be filled via a high-pressure fuel pump.

10. The fuel injection valve according to claim 9, in which the high-pressure fuel delivery is effected from a high-pressure reservoir that is common to all the fuel valves, and the high-pressure reservoir in turn can be filled via a high-pressure fuel pump.

11. The fuel injection valve according to claim 5, in which the high-pressure fuel delivery is effected from a high-pressure reservoir that is common to all the fuel valves, and the high-pressure reservoir in turn can be filled via a high-pressure fuel pump.

12. The fuel injection valve according to claim 6, in which the high-pressure fuel delivery is effected from a high-pressure reservoir that is common to all the fuel valves, and the high-pressure reservoir in turn can be filled via a high-pressure fuel pump.

13. The fuel injection valve according to claim 1, in which the actuator is embodied as an electromechanical actuator, as a piezoelectric actuator or electromagnetic.

14. The fuel injection valve according to claim 2, in which the actuator is embodied as an electromechanical actuator , as a piezoelectric actuator or electromagnetic.

15. The fuel injection valve according to claim 3, in which the actuator is embodied as an electromechanical actuator, as a piezoelectric actuator or electromagnetic.

16. The fuel injection valve according to claim 4, in which the actuator is embodied as an electromechanical actuator, as a piezoelectric actuator or electromagnetic.

17. The fuel injection valve according to claim 5, in which the actuator is embodied as an electromechanical actuator, as a piezoelectric actuator or electromagnetic.

18. The fuel injection valve according to claim 6, in which the actuator is embodied as an electromechanical actuator, as a piezoelectric actuator or electromagnetic.

19. The fuel injection valve according to claim 7, in which the actuator is embodied as an electromechanical actuator, as a piezoelectric actuator or electromagnetic.

* * * * *